US006068013A

United States Patent [19]

Arai et al.

[11] Patent Number: 6,068,013

[45] Date of Patent: May 30, 2000

[54] COUNTER BALANCE VALVE

[75] Inventors: Mitsuru Arai; Seita Hayashi; Sadao Nunotani; Hideki Kado, all of Tochigi-ken, Japan

[73] Assignee: Komatsu Ltd., Tokyo, Japan

[21] Appl. No.: 08/817,414

[22] PCT Filed: Oct. 18, 1995

[86] PCT No.: PCT/JP95/02135

§ 371 Date: Apr. 16, 1997

§ 102(e) Date: Apr. 16, 1997

[87] PCT Pub. No.: WO96/12110

PCT Pub. Date: Apr. 25, 1996

[30] Foreign Application Priority Data

Oct. 18, 1994 [JP] Japan ..... 6-252126

[51] Int. Cl.[7] ..... F15B 13/02

[52] U.S. Cl. ..... 137/106; 91/450; 137/110

[58] Field of Search ..... 137/110, 106, 137/102; 91/420

[56] References Cited

U.S. PATENT DOCUMENTS

| | | | |
|---|---|---|---|
| 2,837,106 | 6/1958 | Bauer | 137/106 |
| 3,980,001 | 9/1976 | Cyphelly | 137/106 X |
| 4,114,516 | 9/1978 | Johnson | 137/106 |
| 5,113,894 | 5/1992 | Yoshida | 137/106 |

FOREIGN PATENT DOCUMENTS

| | | |
|---|---|---|
| 31 51 027 | 7/1983 | Germany . |
| 58-146167 | 10/1983 | Japan . |
| 61-54501 | 4/1986 | Japan . |
| 61-70663 | 5/1986 | Japan . |
| 4-138103 | 12/1992 | Japan . |

*Primary Examiner*—Stephen M. Hepperle
*Attorney, Agent, or Firm*—Wenderoth, Lind & Ponack, L.L.P.

[57] ABSTRACT

In a counter balance valve, a valve body is provided with a valve bore having first and second pump-side ports, first and second motor-side ports and an auxiliary port. A spool is slidably fitted in the valve bore in a longitudinal direction thereof to establish and block communication between the respective ports. Left and right springs maintain the spool at a neutral position in which the respective ports are closed. A left pressure receiving chamber shifts the spool by a pressure oil supplied therein to a first travelling position at which the first pump-side port and the auxiliary port are communicated with each other and the second pump-side port and the second motor-side port are also communicated with each other. A right pressure receiving chamber shifts the spool by a pressure oil supplied therein to a second travelling position at which the second pump-side port and the auxiliary port are communicated with each other and the first pump-side port and the first motor-side port are communicated with each other. The spool is formed with a first axial bore communicated with the left pressure receiving chamber, a second axial bore communicated with the right pressure receiving chamber, first and second small diameter bores communicating the first and second axial bores with the first and second pump-side ports, respectively, and first and second large diameter bores communicating the first and second axial bores with an outer peripheral surface of the spool.

4 Claims, 5 Drawing Sheets

COUNTER BALANCE VALVE

TECHNICAL FIELD

The present invention relates to a counter balance valve provided for a hydraulic circuit arrangement for driving a hydraulic motor used for a travelling apparatus of a construction machine.

BACKGROUND ART

As a hydraulic circuit arrangement for driving a hydraulic motor, there is known a circuit arrangement such as shown in FIG. 1.

In this circuit arrangement, a drain passage la of a hydraulic pump 1 is connected to first and second main circuits 3 and 4 through an operation valve 2, the first and second main circuits 3 and 4 are in turn connected respectively to first and second ports $\mathbf{6}_1$ and $\mathbf{6}_2$ of a hydraulic motor 5, and a supply of pressure oil to the first and second main circuits 3 and 4 is controlled by means of the operation valve 2. Furthermore, a counter balance valve 7 is disposed between the first and second main circuits 3 and 4. According to such arrangement, when the operation valve 2 takes its neutral position N, the first and second main circuits 3 and 4 are communicated with each other and the pressure oil flows out therefrom towards a tank 9, and accordingly, the counter balance valve 7 takes its neutral position N and check valves 8, 8 of the first and second main circuits 3 and 4 are closed to thereby block the hydraulic motor 5 side of the hydraulic circuit arrangement to prevent the hydraulic circuit arrangement to prevent the hydraulic motor 5 from being reversely rotated by an external force. On the other hand, when the operation valve 2 is shifted to a first position a or second position b, the pressure oil is supplied to the first or second main circuit 3 or 4, and the check valve 8 thereof is opened to thereby drive the hydraulic motor 5, and at the same time, the counter balance valve 7 is switched to a first position A or second position B by the pressure oil from the first main circuit 3 or second main circuit 4, and the hydraulic oil in the second main circuit 4 or first main circuit 3 is returned to the tank 9 through the counter balance valve 7 and the operation valve 2.

As mentioned above, the counter balance valve 7 provided for such hydraulic circuit arrangement for driving the hydraulic motor is switched in its position to the first position A or second position B by the pressure oil from the first main circuit 3 or second main circuit 4, and when all the pressure oil flows out from these main circuits 3 and 4, the counter balance valve 7 returns to its neutral position N.

Incidentally, when the supply of the pressure oil to the hydraulic motor 5 is stopped for stopping the operation thereof, the hydraulic motor 5 is rotated by the inertia of the travelling vehicle to attain a pumping function.

For this reason, at the time of stopping the hydraulic motor 5 by shifting the operation valve 2 to its neutral position N, when the counter balance valve 7 is shifted to its neutral position N and the check valve 8 is closed, the pressure oil in one of the first and second main circuits 3 and 4, disposed downstream of the check valve 8, exhibits a high pressure, thereby imparting a large shock at the time of stopping the operation of the hydraulic motor.

Such shock imparted at the time of stopping the operation of the hydraulic motor 5 can be reduced by delaying the shifting speed of the counter balance valve from the first or second position A or B to the neutral position N and throttling the flow of the pressure oil by the counter balance valve 7 so as to cause the pressure oil to gradually flow out the pressure oil to the tank 9. For example, as shown in FIG. 1, throttles 11, 11 are arranged in circuits 10, 10 connecting the counter balance valve 7 to the first and second main circuits 3 and 4, and the degree of throttling of these throttles 11, 11 is made small to thereby delay the returning speed of the counter balance valve 7 to the neutral position N from the first or second position.

However, in such arrangement, it will take considerable time for the counter balance valve 7 to return to its neutral position N, resulting in an occurrence of a cavitation or elongation of the time required for stopping the operation of the hydraulic motor, thereby creating a problem.

There is known a counter balance valve for eliminating this problem such as disclosed in Japanese Utility Model Laid-open Publication No. HEI 4-138103.

This is shown in FIG. 2, in which a valve body 20 is formed with a valve bore 21 to which first and second pump-side ports 22 and 23 and first and second motor-side, ports 24 and 25 are formed, a spool 26 is fitted into the valve bore 21 so as to be slidable in the longitudinal direction thereof to thereby establish communication between the first and second pump-side ports 22 and 23 and the first and second motor-side ports 24 and 25 or to block communication therebetween, and left and right pressure receiving chambers 28 and 29 are formed at positions between the left and right ends of the spool 26 and plugs 40 screwed to the end portions of the valve bore 21, respectively. The spool 26 is maintained in its neutral position, by left and right springs 27, 27 described hereinafter, at which the respective ports are closed, the spool 26 is shifted to a first travelling position by the pressure oil in the left pressure receiving chamber 28 at which the second pump-side port 23 is communicated with the second motor-side port 25, and the spool 26 is shifted to a second travelling position by the pressure oil in the right pressure receiving chamber 29 at which the first pump-side port 22 is communicated with the first motor-side port 24.

Furthermore, the spool 26 is formed with left and right small diameter portions 34 and 35 at its central portion and with axial bores 30 at its left and right end portions, the axial bores 30 at its left and right end portions, the axial bores 30 being communicated with the left and right small diameter portions 34 and 35 through small diameter bores 33, respectively. Further, pistons 31 formed with flanged portions 39 at outer peripheral portions thereof are inserted into the axial bores 30, respectively, and the springs 27 are disposed between the flanged portions 39 and the plugs 40 to keep the spool 26 in its neutral position N by the urging forces of the springs 27 through the flanged portion 39. Still further, the pistons 31 are respectively formed with axial oil bores 36, second small diameter bores 37 communicating the oil bores 36 with the left and right pressure receiving chambers 28 and 29, and radial bores 38 for opening the oil bores 36 to the outer peripheral surfaces of the pistons 31.

In the counter balance valve of the above structure, when the spool 26 takes its neutral position as shown in FIG. 2, the bores 38 are closed by the inner peripheral surfaces of the axial bores 30; when the spool 26 is shifted leftward or rightward from the neutral position to an intermediate position by a predetermined distance $l_2$, the bores 38 are still closed by the inner peripheral surfaces of the axial bores 30; and when the spool 26 takes a position further shifted leftward or rightward by a predetermined distance $l_1$, the bores 38 are communicated with the left or right pressure receiving chambers 28 or 29, and the first or second pump-side port 22 or 23 is communicated with the first or second port 24 or 25.

According to the counter balance valve of the structure described above, when a travelling vehicle is run by positioning the operation valve 2 at the first position a as shown in FIG. 1, the spool 26 is slid rightward by a distance $l_2+l_1$ to take the travelling position. Then, when the operation valve 2 is shifted to its neutral position N from this position, the pressure oil in the first main circuit 3 flows out towards the tank 9 and the pressure therein is reduced, so that the spool 26 is slid leftward by means of the right spring 27.

At this time, the pressure oil in the left pressure receiving chamber 28 flows to the oil bore 36 through the second small diameter bore 37 and the bores 38, flows to the first pump-side port 22 through the first small diameter bore 33, and then flows out into the tank 9 through the first main circuit 3. Accordingly, since the pressure oil flow from the left pressure receiving chamber 28 is throttled only by the first small diameter bore 33, the pressure oil in the left pressure receiving chamber 28 smoothly flows into the tank 9, and as a result, since the spool 26 can be slid at high speed, the occurrence of any cavitation can be prevented and the speed reduction can be done with an improved follow-up performance.

At a time when the spool 26 is shifted leftward by the distance $l_1$ to take its intermediate position, the bore 38 is closed by the inner peripheral surface of the axial bore 30, the left pressure receiving chamber 28 is communicated with the first pump-side port 22 through the second small diameter bore 37 and the first small diameter bore 33, the pressure oil flow is throttled by two small diameter bores 37 and 33 to attain substantially the same function as that attained by making a throttle diameter smaller than before, the pressure oil in the left pressure receiving chamber 28 hence flows out gradually towards the tank 9 and the spool 26 is moved leftward by the distance $l_2$ to take the neutral position shown in FIG. 2. Accordingly, at this time, since the spool 26 is slid leftward with a low speed, a shock to be caused at the time of the operation stop of the hydraulic motor 5 is made small. Further, at a time when a vehicle runs down a slope, although substantially the same state is provided, a hunching phenomenon can be suppressed because of a large damping effect at this time.

As mentioned above, when the spool 26 of the counter balance valve 7 is slid from the travelling position to the neutral position, the spool 26 is slid with a high speed during a first half sliding time from the travelling position to the intermediate position and slide with a low speed during a latter half sliding time from the intermediate position to the neutral position, so that the occurrence of cavitation during the first half sliding time in which the counter balance valve 7 is slid with a high speed can be prevented and the operation of the hydraulic motor can be slowed and stopped with no occurrence of a large shock during the latter half sliding time in which the counter balance valve is slid with a low speed.

Therefore, according to the counter balance valve of the structure described above, the hydraulic motor can be reduced in speed and then stopped with reduced shock while preventing cavitation from occurring, and the hydraulic motor can be stopped in a short time by shifting the spool 26 to the neutral position in a short time.

However, because such counter balance valve is composed of the valve body 20, the spool 26 and the two pistons 31, the number of the constructional parts or components is increased, thereby increasing manufacturing costs and involving troublesome assembly work, thus also creating a problem.

Furthermore, since the piston 31 is provided with the flanged piston 39, the oil bore 36, the second small diameter bore 37 and the bore 38, the manufacturing of the piston 39 involves troublesome work and high cost, and accordingly, the counter balance valve itself becomes expensive.

The present invention was conceived, in view of the above problems, for providing a counter balance valve composed of a reduced number of constructional parts with reduced manufacturing costs and which is capable of being easily assembled.

SUMMARY OF THE INVENTION

To achieve the above object, according to one embodiment of the present invention, there is provided a counter balance valve, which is characterized in that a valve body is provided with a valve bore having first and second pump-side ports, first and second motor-side ports and an auxiliary port. A spool is fitted in the valve bore to be slidable in a longitudinal direction thereof so as to establish communication between the respective ports and to block the communication therebetween. Left and right springs maintain the spool in a neutral position thereof at which the respective ports are closed. A left pressure receiving chamber acts to shift the spool by a pressure oil supplied therein to a first travelling position at which the first pump-side port and the auxiliary port are communicated with each other and the second pump-side port and the second motor-side port are also communicated with each other, and a right pressure receiving chamber acts to shift the spool by a pressure oil supplied therein to a second travelling position at which the second pump-side port and the auxiliary port are communicated with each other and the first pump-side port and the first pump-side port are also communicated with each other. The spool is formed with a first axial bore communicated with the left pressure receiving chamber, a second axial bore communicated with the right pressure receiving chamber, first and second small diameter bores always communicating the first and second axial bores with the first and second pump-side ports, respectively, and first and second large diameter bores communicating the first and second axial bores with an outer peripheral surface of the spool. The first and second large diameter bores are closed when the spool is positioned in the neutral position and an intermediate position between the first and second travelling positions, and the first and second large diameter bores are communicated with the auxiliary port when the spool is positioned in the first and second travelling positions, respectively.

According to the structure described above, when the spool is moved towards the neutral position from the travelling position, in the first half movement thereof to the intermediate position, the pressure oil in the left and right pressure receiving chambers flows out smoothly through the small and large diameter bores, and when the spool is further moved to the neutral position, the pressure oil flows out only through the small diameter bore with reduced flow rate, so that the moving speed of the spool is made faster in the first half movement but is delayed in the later half movement. Accordingly, the spool can be returned to the neutral position in a short time while preventing cavitation from occurring, and moreover, a portion between the second and first motor-side ports and the second and first pump-side ports can be gradually closed, thereby reducing and then stopping the operation of the hydraulic motor without imparting a shock.

Furthermore, because the counter balance valve is composed of the valve body and the spool, components constituting the valve can be eliminated.

In the Structure of the counter balance valve mentioned above, in a preferred arrangement, the auxiliary port is formed at an intermediate portion between the first and second pump-side ports, the spool is formed with a left small diameter portion so as to establish communication between the first pump-side port and the first motor-side port and between the first pump-side port and the auxiliary port and to block the communication. The spool is formed with a right small diameter portion so as to establish communication between the second pump-side port and the second motor-side port and between the second pump-side port and the auxiliary port and to block the communication. The first and second small diameter bores are open to the left and right small diameter portions, respectively, and the first and second large diameter bores are open to the outer peripheral surface to the spool at portions near the auxiliary port other than the small diameter bores. When the spool is positioned in the neutral position, the first and second large diameter bores are closed by an inner peripheral surface of the valve bore and when the spool is shifted leftward or rightward by more than a predetermined distance from the neutral position thereof, the first and second large diameter bores are communicated with the auxiliary bore.

Furthermore, it may be possible that the auxiliary port is communicated with a hydraulic circuit which acts to release a brake for braking the hydraulic motor.

BRIEF DESCRIPTION OF THE DRAWINGS

The present invention will be made more clear from the following detailed explanation and with reference to preferred embodiment represented by the accompanying drawings. Further, it is to be noted that the embodiment shown in the drawings does not specify the present invention and is described for the explanation thereof for easy understanding the same.

In the accompanying drawings.

PREFERRED EMBODIMENT OF THE INVENTION

A counter balance valve according to a preferred embodiment of the present invention will be described hereunder with reference to the accompanying drawings.

Figure 3:
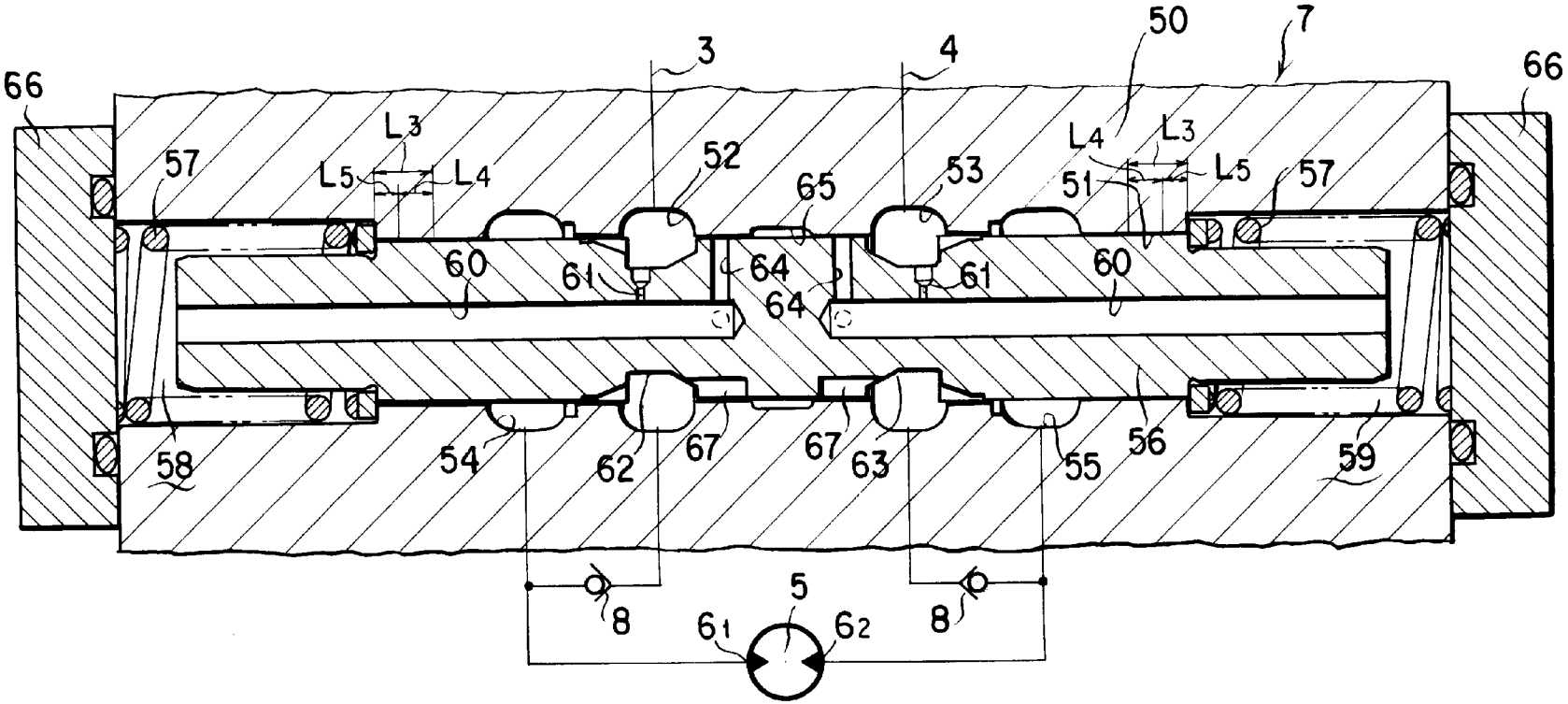
FIG. 3 is a sectional view of a counter balance valve in its neutral position according to one embodiment of the present invention.

As shown in FIG. 3, a valve bore 51 is formed in a valve body 50, and first and second pump-side ports 52 and 53, first and second motor-side ports 54 and 55 and an auxiliary port 65 are formed at the valve bore 51 so that the respective ports are communicated with or blocked from communication with each other by means of a spool 56 inserted into the valve bore 51 to be slidable. The spool 56 is kept in its neutral position N by means of a pair of springs 57, 57, and is slidable towards a first position A and a second position B shown in FIG. 1 by pressures in left and right pressure receiving chambers 58 and 59 formed between left and right end portions of the spool 56 and left and right covers 66 closing both ends of the valve bore 51. When the spool 56 takes the first position A, the second pump-side port 53 and the second motor-side port 55 are communicated with each other through a right small diameter portion 63 mentioned hereinafter, and the first pump-side port 52 and the auxiliary port 65 are communicated with each other through a left small diameter portion 62 and a cutout 67 formed continuously therewith, mentioned hereinafter. Further, when the spool 56 takes the second position B, the first pump-side port 52 and the first motor-side port 54 are communicated with each other through the left small diameter portion 62 mentioned hereinafter, and the second pump-side port 53 and the auxiliary port 65 are communicated with each other through the right small diameter portion 63 and a cutout 67 formed continuously therewith, mentioned hereinafter.

The auxiliary port 65 is communicated with a hydraulic circuit acting to release a brake for braking the hydraulic motor 5.

The left and right small diameter portions 62 and 63 are formed at the central portion of the spool 56 which is formed with axial bores 60 formed to the left and right portions thereof. The axial bores 60 are communicated respectively with the small diameter portions 62 and 63 through radial bores 61 having small diameters and are opened to the outer peripheral surface of the spool 56 through large diameter bores 64. The axial bores 60 are also communicated with the left and right pressure receiving chambers 58 and 59, respectively.

Figure 1:
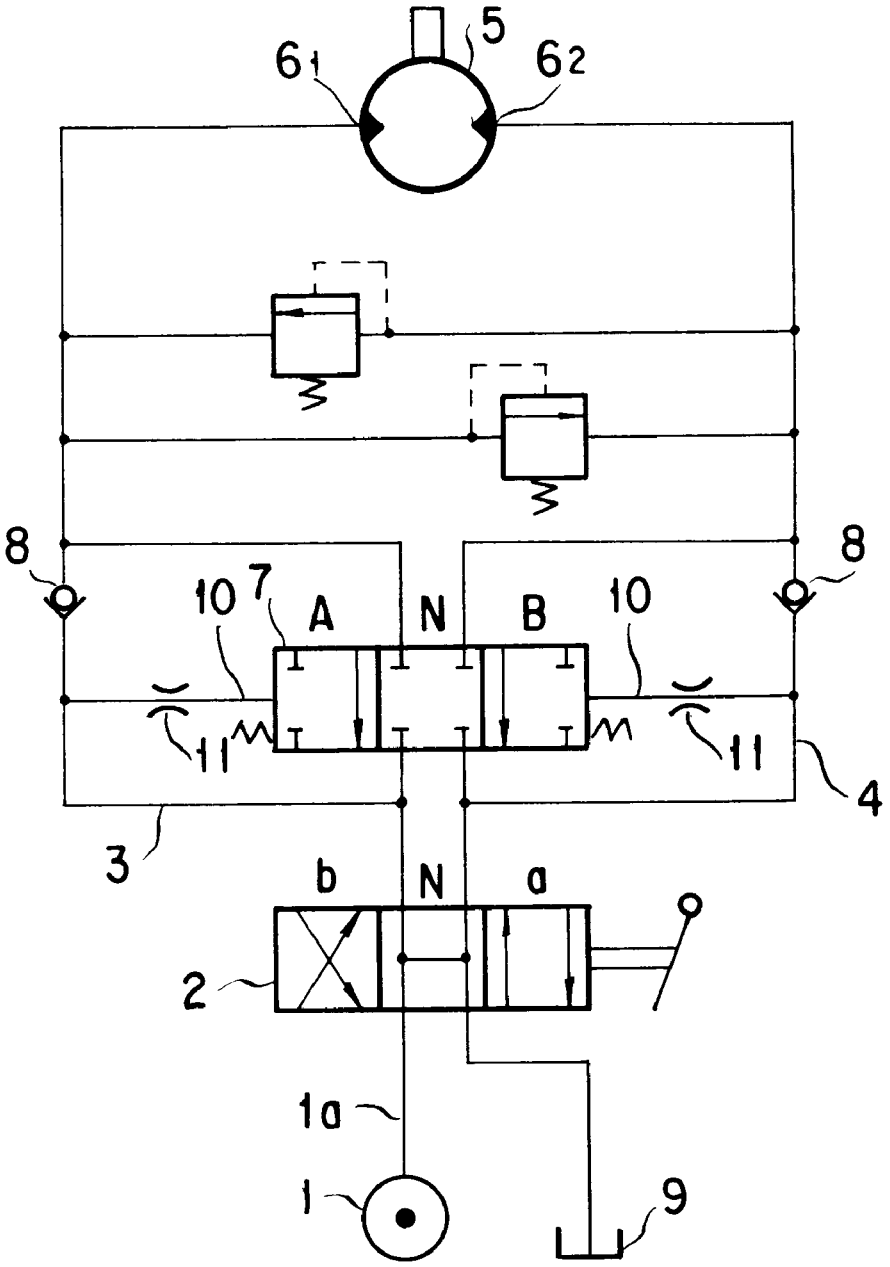
FIG. 1 PRIOR ART
FIG. 1 is a known hydraulic circuit diagram for driving a hydraulic motor.
Figure 2:
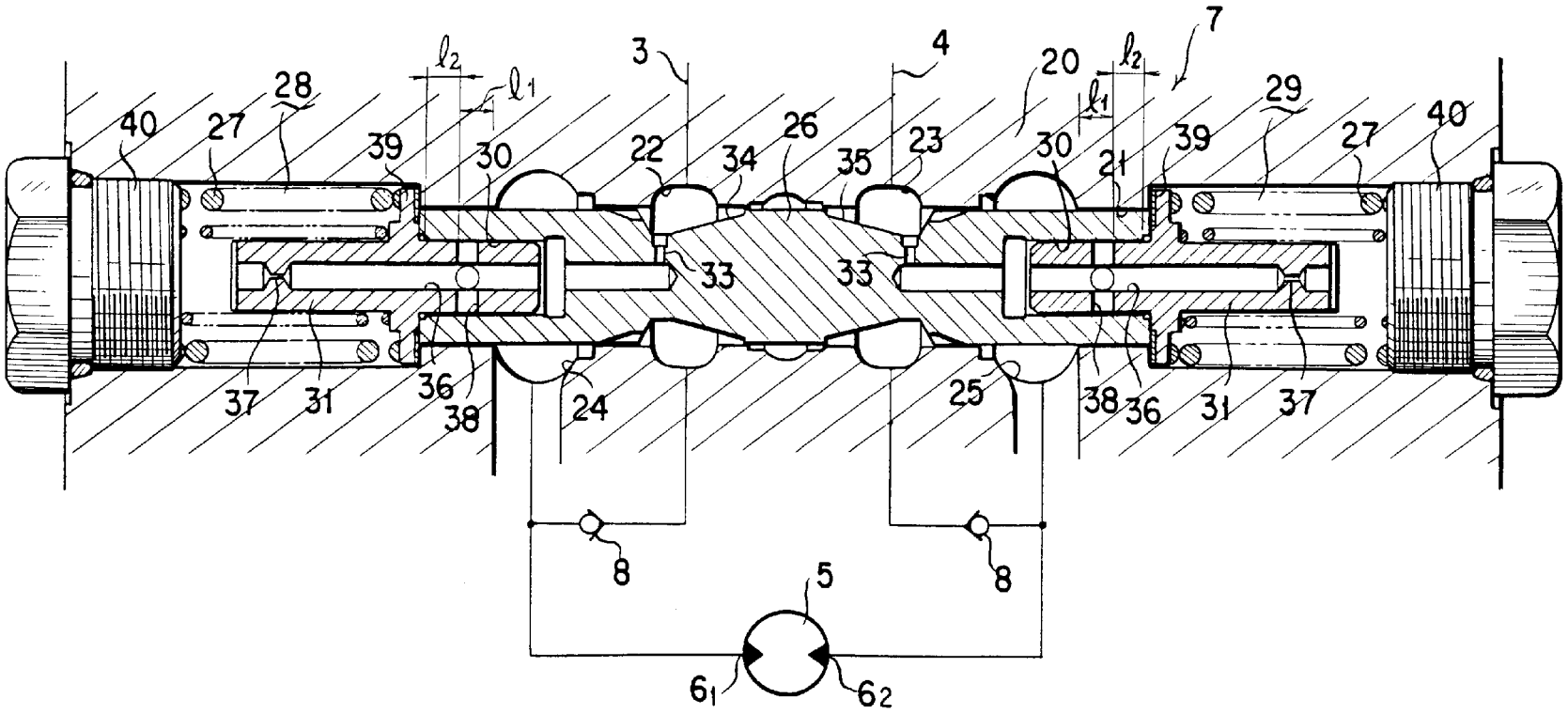
FIG. 2 PRIOR ART
FIG. 2 is a sectional view of a counter balance valve of conventional structure.

The first and second pump-side ports 52 and 53 are connected, as shown in FIG. 1, to the first and second main circuits 3 and 4, respectively, and the first and second motor-side ports 54 and 55 are connected to the first and second ports $6_1$ and $6_2$ of the hydraulic motor 5, respectively.

The counter balance valve of this embodiment operates as follows.

When the operation valve 2 shown in FIG. 1 takes its neutral position N, the spool 56 of the counter balance valve 7 takes its neutral position as shown in FIG. 3, and at that time, the large diameter bores 64 are closed by the inner peripheral surface of the valve bore 51.

Figure 4:
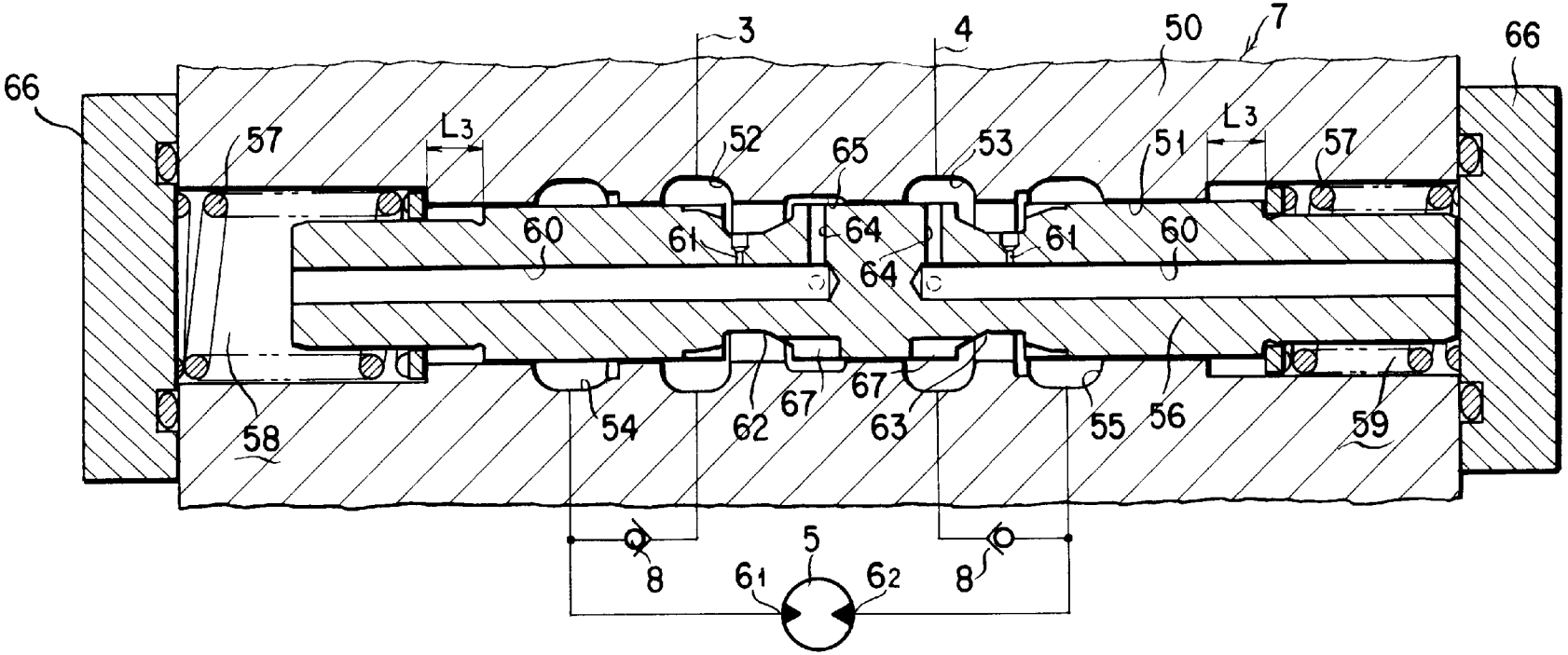
FIG. 4 is a sectional view of the counter balance valve of FIG. 3 in a travelling state.

When the operation valve 2 is then shifted to the first position a from the neutral position N, the drain pressure oil from the hydraulic pump 1 is supplied to the first main circuit 3, and accordingly, the pressure oil in the first main circuit 3 flows in the left pressure receiving chamber 58 through the first pump-side port 52, the small diameter bore 61 and the axial bore 60 to thereby push the spool 56 rightward by a distance $L_3$ to a travelling position shown in FIG. 4. At this time, the second pump-side port 53 and the second motor-side port 55 are communicated together through the right small diameter portion 63, and the left large diameter bore 64 is communicated with the auxiliary port 65 formed at the valve bore 51.

Therefore, the pressure oil is supplied to the first port $6_1$ of the hydraulic motor 5 and the pressure oil flowing out through the second port $6_2$ flows towards the tank 9 through the second motor-side port 55, the second pump-side port 53 and the second main circuit 4.

When the operation valve 2 is then shifted from the state mentioned above to the neutral position N, the pressure oil in the first main circuit 3 flows out to the tank 9, and at that time, since the pressure of the oil is reduced, the spool 56 is slid in the bilateral directions by means of the right spring 57.

In this instance, the pressure oil in the left pressure receiving chamber 58 flows to the first pump-side port 52 and then flows out into the tank 9 through the first main circuit 3 and to the auxiliary port 65 through the axial bore 60 and the large diameter bore 64. At this time, the communication between the first pump-side port 52 and the auxiliary port 65 is established. Accordingly, the throttle opening area for throttling the flow-out passage of the pressure oil in the left pressure receiving chamber 58 is a sum of the opening area of the first small diameter bore 61 and that of the large diameter bore 64, thus being large, so that the pressure oil in the left pressure receiving chamber 58 flows out therefrom smoothly, and moreover, since the spool 56 is slid at a high speed, the occurrence of the cavitation can be substantially prevented and the hydraulic motor can be reduced in speed and provided with an improved follow-up performance.

Figure 5:
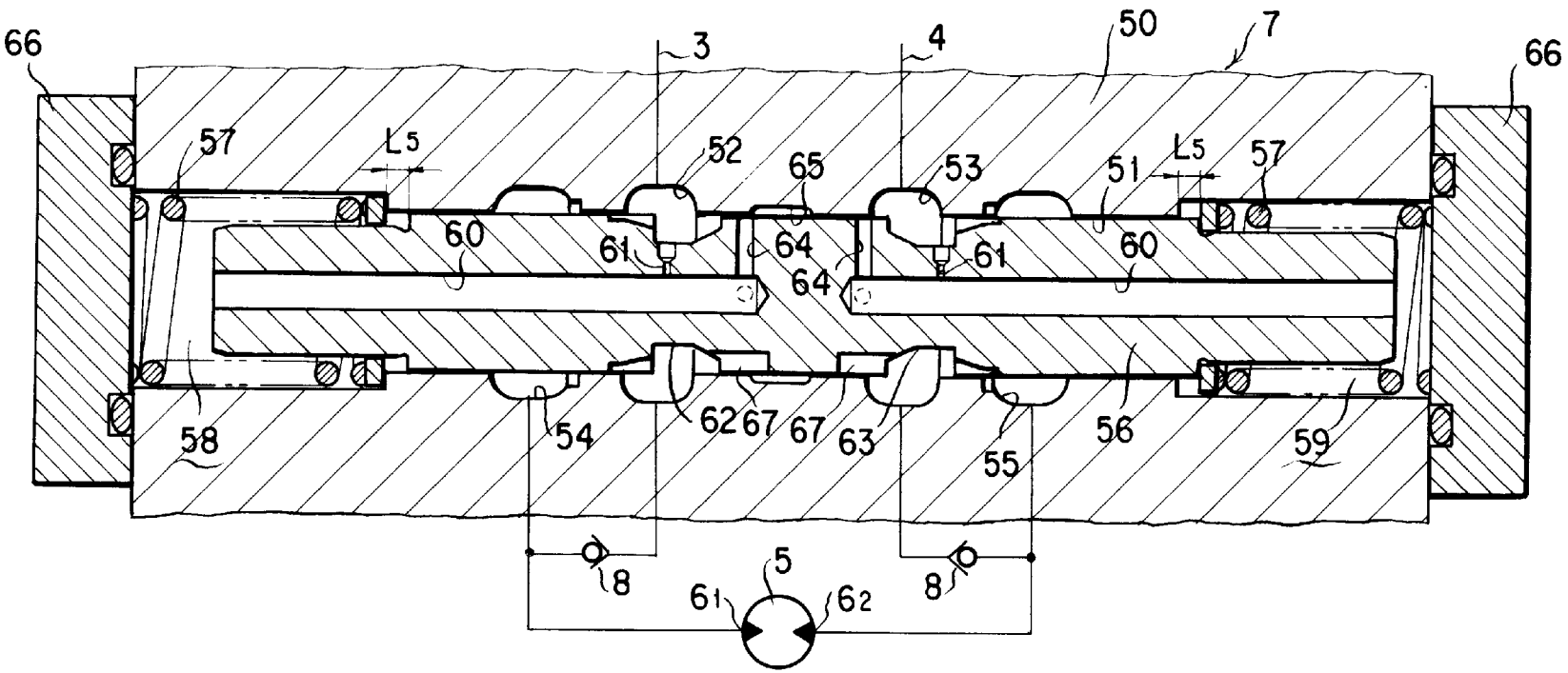
FIG. 5 is a sectional view of the counter balance valve of FIG. 3 in an intermediate state.

Then, when the spool 56 takes the intermediate position shown in FIG. 5 by being shifted leftward by a distance $L_4$, the large diameter bore 64 is closed by the inner peripheral surface of the valve bore 51 and the pressure oil in the left pressure receiving chamber 58 flows out to the first pump-side port 52 through the axial bore 60 and the small diameter bore 61. At this time, the opening area of the pressure oil flow-out passage equals the opening area of the small diameter bore 61, thus being small, so that the pressure oil in the left pressure receiving chamber 58 gradually flows out towards the tank 9 and the spool 56 moves leftwardly to the neutral position shown in FIG. 3 by a distance $L_5$. Accordingly, at this time, since the spool 56 is slid leftwardly with a reduced speed, the operation of the hydraulic motor 5 stops with reduced shock. Further, although substantially the same state is taken when the vehicle descends a slope, a large dumping effect is attained, so that the hunching phenomenon can be suppressed.

As mentioned above, the spool 56 of the counter balance valve 7 is slid with high speed during the first half movement from its travelling position to its intermediate position and with a low speed during the latter half movement from its intermediate position to the neutral position, so that the occurrence of the cavitation can be prevented during the first half movement at which the counter balance valve 7 is slid with a high speed and the hydraulic motor can be reduced in speed and stopped in the latter half movement with reduced shock.

Accordingly, the hydraulic motor 5 can be stopped in a short time by shifting the spool 56 to the neutral position in a short time, and the hydraulic motor 5 can be slowed and stopped with reduced shock while preventing cavitation from occurring.

Furthermore, the counter balance valve according to the present invention is composed of only the valve body and the spool, so that constructional parts can be eliminated, the manufacturing cost is reduced, and the assembly work is made easy.

Although the present invention has been illustrated and described with respect to exemplary embodiment thereof, it should be understood by those skilled in the art that the foregoing and various other changes, deletions and additions may be made thereto without departing from the scope of the present invention. Therefore, the present invention should not be understood as limited to the specific embodiments described above but to include all possible embodiments which can be embodied within a scope encompassed and equivalents thereof with respect to the features recited in the appended claims.

We claim:

1. A counter balance valve comprising:

a valve body provided with a valve bore having first and second pump-side ports, first and second motor-side ports and an auxiliary port, a spool fitted in the valve bore to be slidable in a longitudinal direction thereof so as to establish communication between said respective ports and to block the communication therebetween, left and right springs maintaining the spool in a neutral position thereof at which said respective ports are closed, a left pressure receiving chamber acting to shift said spool by a pressure oil supplied therein to a first travelling position at which said first pumpside port and said auxiliary port are communicated with each other and said second pump-side port and said second motor-side port are also communicated with each other, and a right pressure receiving chamber acting to shift said spool by a pressure oil supplied therein to a second travelling position at which said second pump-side port and said auxiliary port are communicated with each other and said first pump-side port and said first motor-side port are also communicated with each other;

wherein said spool is formed with a first axial bore communicated with said left pressure receiving chamber, a second axial bore communicated with said right pressure receiving chamber, first and second small diameter bores always communicating said first and second axial bores with said first and second pump-side ports, respectively, and first and second large diameter bores communicating said first and second axial bores with an outer peripheral surface of said spool; and wherein said first and second large diameter bores are closed when said spool is positioned in the neutral position and an intermediate position between said first and second travelling positions, and said first and second large diameter bores are communicated with said auxiliary port when said spool is positioned in said first and second travelling positions, respectively.

2. A counter balance valve according to claim 1, wherein said auxiliary port is formed at an intermediate portion between said first and second pump-side ports, said spool is formed with a left small diameter portion so as to establish communication between said first pump-side port and said first motor-side port and between said first pump-side port and said auxiliary port and to block the communication, said spool is formed with a right small diameter portion so as to establish communication between said second pump-side port and said second motor-side port and between said second pump-side port and said auxiliary port and to block the communication, said first and second small diameter bores are open to said left and right small diameter portions, respectively, and said first and second large diameter bores are open to the outer peripheral surface of the spool at portions near said auxiliary port other than said small diameter bores, and wherein when said spool is positioned in the neutral position, said first and second large diameter bores are closed by an inner peripheral surface of the valve bore and when said spool is shifted leftward or rightward by more than a predetermined distance from the neutral position thereof, said first and second large diameter bores are communicated with said auxiliary bore.

3. A counter balance valve according to claim 1, herein said auxiliary port is communicated with a hydraulic circuit acting for releasing a brake for braking the hydraulic motor.

4. A counter balance valve according to claim 2, wherein said auxiliary port is communicated with a hydraulic circuit acting for releasing a brake for braking the hydraulic motor.

* * * * *